United States Patent [19]

Zientek et al.

[11] Patent Number: 4,726,734

[45] Date of Patent: Feb. 23, 1988

[54] CENTRIFUGAL PUMP

[75] Inventors: Albert Zientek, Meckesheim; Hermann Ziesel, Sinsheim, both of Fed. Rep. of Germany

[73] Assignee: Sero Pumpenfabrik GmbH, Meckesheim, Fed. Rep. of Germany

[21] Appl. No.: 753,697

[22] Filed: Jul. 10, 1985

[30] Foreign Application Priority Data

Jul. 12, 1984 [DE] Fed. Rep. of Germany ..... 3425656

[51] Int. Cl.[4] ..... F04D 9/00

[52] U.S. Cl. ..... 415/143; 415/198.2

[58] Field of Search ..... 415/143, 199.1, 198.1, 415/198.2

[56] References Cited

U.S. PATENT DOCUMENTS

| | | | |
|---|---|---|---|
| 2,875,698 | 3/1959 | Roth | 415/143 |
| 3,385,225 | 5/1968 | Hagemann | 415/143 |
| 3,614,256 | 10/1971 | Sieghartner | 415/143 |
| 4,299,536 | 11/1981 | Sieghartner et al. | 415/198.2 |
| 4,390,317 | 6/1983 | Lehmann et al. | 415/198.1 |

FOREIGN PATENT DOCUMENTS

| | | | |
|---|---|---|---|
| 513423 | 8/1952 | Belgium | 415/143 |

*Primary Examiner*—Robert E. Garrett
*Assistant Examiner*—John T. Kwon
*Attorney, Agent, or Firm*—Peter K. Kontler

[57] ABSTRACT

A centrifugal pump which is used to convey a liquefied gaseous fluid has a housing with an inlet which extends axially and an outlet which extends radially of the pump shaft. The shaft drives the impellers of several coaxial stages including a first stage which is a full-admission standard-impeller-type stage, a last stage which is a partial-admission self-priming regenerative stage, and a compressor stage upstream of the first stage. The pump can convey liquefied gases from a vessel which is located at a level well below the housing. If the liquefied fluid is converted back into a gaseous fluid as a result of prolonged idleness of the pump, the compressor stage reconverts the gas into a liquid and such liquid is then conveyed to the regenerative stage by the first stage so that the regenerative stage is ready to immediately proceed with the self-priming operation.

5 Claims, 1 Drawing Figure

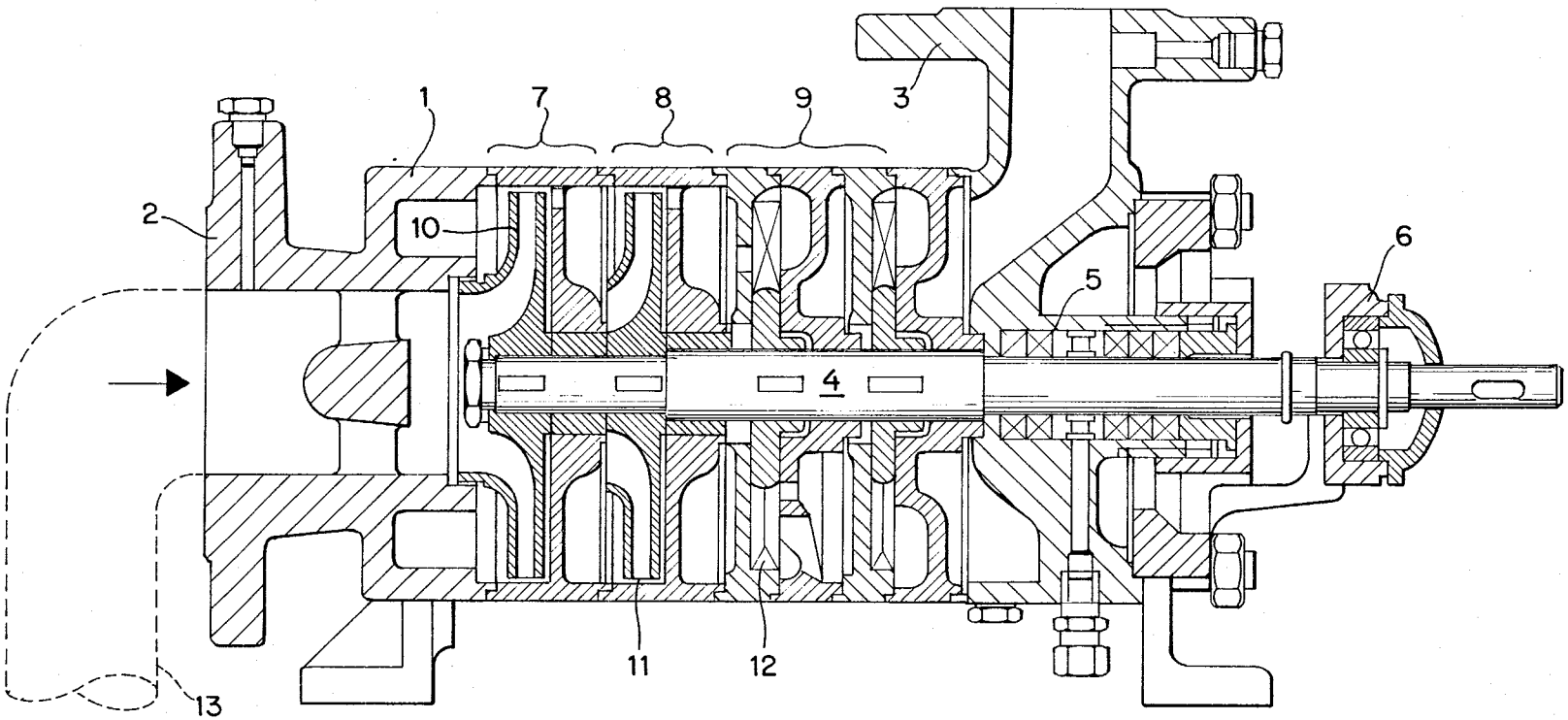
1
2
3
4
5
6
7
8
9
10
11
12
13

CENTRIFUGAL PUMP

BACKGROUND OF THE INVENTION

The present invention relates to centrifugal pumps in general, and more particularly to improvements in multistage centrifugal pumps of the type wherein the housing has an inlet extending axially and an outlet extending radially of the pump shaft and the stages include a full-admission standard-impeller-type first stage and at least one partial-admission self-priming regenerative stage downstream of the first stage.

Pumps of the above outlined character are often utilized when the conditions for admission of a liquid medium into the inlet of the pump housing are far from optimal, e.g., when the liquid medium must be sucked from a source which is located at a level well below that of the inlet of the pump housing or when the inlet is located at a level below but close to the level of the source of supply of the liquid medium. The first stage enhances the so-called suction behavior of the pump, namely the NPSH (net positive suction head) value, but without considering the efficiency and the pump head. The regenerative stage renders it possible to increase the pressure of the conveyed fluid medium at a loW RPM and with a small number of stages.

German Offenlegungsschrift No. 15 28 826 discloses a centrifugal pump of the above outlined character wherein the diameter of the radial impeller of the first stage is smaller than the diameter of the star wheel of the regenerative stage. This enhances the overall design of the pump but the pump cannot be used for the conveying of liquefied gases because the self-priming operation is ensured only in the presence of an auxiliary liquid.

In many countries, the laws, rules and regulations pertaining to safety in connection with the storage of liquefied gases are so stringent that the source of supply (such as a tank or another vessel) of liquefied gaseous medium must be (or preferably is) confined well below the ground level. In view of such location of the source, the pump which is used to draw the liquefied gaseous medium must be installed close to the source (and hence at a level well below the ground), i.e., such pump must constitute an elongated submersible motor pump which is not only complex and expensive due to the need for reliable encapsulation of the pump and the motor therefor but is also unaccessible or hard to reach for inspection, repair or replacement. Alternatively, the pump is a suction pump which is mounted at a level above or on the ground. Such pump must be a self-priming pump which operates without cavitation. The heretofore known pumps fail to meet these requirements because excessive quantities of liquid are evacuated therefrom in response to each interruption of liquid flow through the housing. The upper level of the liquid is then located at the lowermost point in the inlet of the pump housing so that the liquid which remains in the housing does not suffice to ensure reliable evacuation of gases from the suction pipe and adequate priming when the motor is started again.

At least in many instances, a pump which is used to convey a liquefied gas is further required to convey a medium which is devoid of gas bubbles or other forms of inclusions of gaseous media. On the other hand, and if the pump is called upon to convey a liquefied gas, it is practically impossible to prevent at least partial conversion of liquefied gas into the gaseous phase, especially if the inlet of the pump housing must draw liquefied gas under less than optimum circumstances. Evaporation of some liquefied gas entails an increase of pressure which, in turn, entails liquefaction of some of the gaseous phase in the region of the inlet and in the suction pipe which delivers liquefied gas from a source that is confined in the ground. Nevertheless, it is necessary to provide such pumps with gas separators which are supposed to ensure that the housing receives a stream which is devoid of any bubbles.

European Pat. No. 45 483 discloses a centrifugal pump wherein the housing contains a rather large liquid reservoir which is installed between the first stage and the regenerative stage. The liquid which is confined in the reservoir is intended to ensure reliable self-priming in response to renewed starting of the pump. However, it has been found that the provision of a reservoir between the first stage and the regenerative stage does not guarantee reliable and predictable functioning of the pump, especially as regards the operation following renewed starting after a relatively long or even after a short interval of idleness. It happens frequently that the entire supply of liquefied gas in the reservoir is reconverted into a gas when the pump is idle for an extended interval of time or when the confined medium is not maintained at an optimum temperature. For example, if the pump is installed above the ground level and is heated by sunshine to a temperature well above that of the liquefied gas in the underground vessel, the entire supply of liquefied gas in the reservoir which is provided in the interior of the pump housing is likely to be reconverted into a gas so that the regenerative stage is incapable of ensuring a predictable self-priming action. This necessitates the utilization of complex and expensive electronic controls which monitor the aggregate state in the reservoir and ensure the admission of liquefied gas when the supply of liquefied gas in the reservoir is depleted below the minimum acceptable value. The electronic controls are reliable only as long as they receive electrical energy but they fail completely in the event of a blackout or another failure of the source of electrical energy and/or of the means for connecting the controls with such source.

OBJECTS AND SUMMARY OF THE INVENTION

An object of the invention is to provide a centrifugal pump which can be used for reliable conveying of liquefied gases even under most adverse circumstances when the heretofore known pumps cannot do the job.

Another object of the invention is to provide a centrifugal pump which can ensure that its regenerative stage or stages are primed without delay as soon as the pump is put to renewed use, irrespective of the length of the interval of idleness and/or of the difference between the levels of the pump and the source of supply of liquefied gas and/or the prevailing temperature or temperatures.

A further object of the invention is to provide a novel and improved method of ensuring predictable self-priming of the regenerative stage in a centrifugal pump of the above outlined character.

Still another object of the invention is to provide a centrifugal pump which can ensure rapid and predictable conversion of a gaseous medium into the liquid phase in response to starting of the motor which drives the pump shaft.

A further object of the invention is to provide the above outlined pump with a novel array of stages.

Another object of the invention is to provide the pump with novel and improved means for ensuring predictable self-priming of the regenerative stage without resorting to electronic or other controls and/or to reservoirs for liquid medium in the interior of the pump housing.

The invention resides in the provision of a centrifugal pump which is particularly suitable for conyeying of liquefied gases. The pump comprises a housing and a shaft which is rotatably journalled in the housing. The latter has an inlet which extends axially and an outlet which extends radially of the shaft. The pump further comprises a plurality of stages which are disposed intermediate the inlet and the outlet (as considered in the direction of fluid flow from the inlet to the outlet) and include a standard-impeller-type full-admission first stage, a self-priming partial-admission regenerative stage downstream of the first stage, and at least one additional (compressor) stage upstream of the first stage. At least one of the stages includes a radial impeller or a radial compressor wheel. For example, the additional stage can comprise a radial compressor wheel, the first stage can comprise a radial impeller, and the regenerative stage can comprise a star wheel.

A conduit is preferably provided to deliver the fluid medium to the inlet from a vessel or another suitable source of preferably liquefied gaseous fluid which is installed at a level below that of the pump housing.

The novel features which are considered as characteristic of the invention are set forth in particular in the appended claims. The improved centrifugal pump itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a schematic axial vertical sectional view of a centrifugal pump which embodies one form of the present invention and comprises a composite regenerative stage, a single first stage, and a single compressor stage upstream of the first stage, the direction of flow of a liquid medium into the inlet of the pump housing from a source of supply at a level below the pump being indicated by an arrow.

DESCRIPTION OF THE PREFERRED EMBODIMENTS

The drawing shows a centrifugal pump which is used for conveying a liquefied gaseous fluid from a level below the housing 1. The latter comprises an inlet 2 which is coaxial with and an outlet 3 which extends radially of the horizontal pump shaft 4. The shaft 4 is journalled in two bearings 5 and 6 and is driven by a suitable motor, not shown. The pump comprises a first stage 8 which is a standard-impeller-type full-admission stage, a final or last stage 9 which is a partial-admission self-priming regenerative stage downstream of the stage 8, and an additional stage 7 which is disposed upstream of the stage 8, as considered in the direction of fluid flow from the inlet 2 to the outlet 3.

The additional stage 7 is a compressor stage with a radial compressor impeller or wheel 10, the stage 8 has a radial impeller 11, and the stage 9 has a star wheel 12. Each of the stages further comprises an appropriate casing.

In the illustrated embodiment, the stage 9 is actually a composite stage which is assembled of two identical stages. Each of the other two stages 7 and 8 is a single stage. The total number of stages can be varied within a wide range, as long as the improved centrifugal pump includes the combination of the full-admission stage (such as 8), partial-admission stage (such as 9) and compressor stage (7).

The reference character 13 denotes a portion of a conduit which serves to supply the fluid medium from a level below that of the housing 1, e.g., from a tank or from another vessel which can be confined in the ground or otherwise mounted at a level below the pump.

An important advantage of the improved pump is that it can initiate the self-priming conveying operation without an auxiliary fluid. This is accomplished by the provision of the additional stage upstream of the first stage and by the provision of several stages which are located upstream of the regenerative stage and include radial impellers and/or radial compressor wheels. Thus, all that is necessary is to add an additional stage in a pump which comprises a standard-impeller-type full-admission stage and a partial-admission self-priming regenerative stage.

When the liquefied medium is converted back into a gas, the gas is compressed and liquefied by the stage 7 upstream of the stages 8 and 9. This ensures that, when the pump is started anew, its housing rapidly gathers a supply of liquid which constitutes the auxiliary liquid that is needed for self-priming. The purpose of the first stage is to exert a beneficial influence upon the NPSH (net positive suction head) value and to convey the thus obtained auxiliary liquid from the compressor stage 7 to the regenerative stage 9 whereby the latter initiates the self-priming operation.

The novel combination of the aforediscussed stages 7, 8 and 9 ensures that the centrifugal pump is ready for immediate conveying of liquefied gases, even after long periods of idleness and/or under other unsatisfactory circumstances and even if the vessel for the liquefied gas is located at a level well below the pump housing 1 (e.g., if the vessel is buried deep in the ground below the pump which can be mounted on the ground) and in total absence of any reservoirs regulating units or the like.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A centrifugal pump for conveying liquefied gases, comprising a housing; a shaft rotatably mounted in said housing, said housing having an inlet disposed axially and an outlet disposed radially of said shaft; and a plurality of stages intermediate said inlet and said outlet as considered in the direction of fluid flow through said housing, said stages including a standard-impeller-type full-admission first stage for improving the net positive suction head, a partial-admission self-priming regenerative stage downstream of said first stage for increasing the pressure of a liquefied gas, and a compressor stage upstream of said first stage for compressing liquefied gas vapors.

2. The centrifugal pump of claim 1, wherein at least one of said stages includes a radial impeller.

3. The centrifugal pump of claim 1, wherein at least one of said stages includes a radial compressor wheel.

4. The centrifugal pump of claim 1, wherein at least one of said first and compressor stages includes a radial compressor wheel.

5. The centrifugal pump of claim 1, further comprising means for supplying to said inlet a fluid medium from a level below said housing.

* * * * *